US005167785A

United States Patent [19]

McCready

[11] Patent Number: 5,167,785

[45] Date of Patent: Dec. 1, 1992

[54] THIN ELECTRODES

[76] Inventor: David F. McCready, 2000 7th Ave., Altoona, Pa. 16608

[21] Appl. No.: 565,216

[22] Filed: Aug. 9, 1990

Related U.S. Application Data

[63] Continuation of Ser. No. 422,509, Oct. 7, 1989, abandoned.

[51] Int. Cl.[5] ..... C23F 13/00

[52] U.S. Cl. ..... 204/196; 204/147; 204/294

[58] Field of Search ..... 204/147, 148, 196, 197, 204/294

[56] References Cited

U.S. PATENT DOCUMENTS

| | | | |
|---|---|---|---|
| 2,776,940 | 1/1957 | Oliver . | |
| 2,776,941 | 1/1957 | Wagner . | |
| 2,856,342 | 10/1958 | van der Hoeven et al. | 204/197 |
| 2,870,074 | 1/1959 | Parker . | |
| 2,882,213 | 4/1959 | Douglas | 204/197 |
| 2,974,389 | 3/1961 | Tatum | 204/197 |
| 2,999,800 | 9/1961 | Reeside | 204/196 |
| 3,239,443 | 3/1966 | Bryan et al. | 204/196 |
| 3,260,661 | 7/1966 | Kemp et al. | 204/197 |
| 3,377,150 | 4/1968 | Corley et al. . | |
| 3,408,280 | 10/1968 | Preiser . | |
| 3,410,772 | 11/1968 | Geld et al. . | |
| 3,867,274 | 2/1975 | Herman | 204/197 |
| 3,893,903 | 7/1975 | Lindholm . | |
| 4,096,051 | 6/1978 | Annis, Jr. et al. . | |
| 4,226,694 | 10/1980 | Baboian et al. . | |
| 4,369,104 | 1/1983 | Beckley | 204/294 |
| 4,487,676 | 12/1984 | Parker et al. | 204/196 |
| 4,502,929 | 3/1985 | Stewart et al. | 204/147 |
| 4,515,669 | 5/1985 | Dimond et al. . | |
| 4,609,454 | 9/1986 | Ziegler | 204/428 |
| 4,647,353 | 3/1987 | McCready | 204/196 |
| 4,798,658 | 6/1989 | Herzog et al. . | |
| 4,808,294 | 2/1989 | Beuret et al. | 204/427 |
| 4,855,027 | 8/1989 | McCready | 204/196 |
| 4,915,808 | 4/1990 | McCready et al. | 204/196 |

FOREIGN PATENT DOCUMENTS

| | | |
|---|---|---|
| 1227405 | 4/1971 | United Kingdom . |

*Primary Examiner*—T. Tung

*Attorney, Agent, or Firm*—James Creighton Wray

[57] ABSTRACT

A thin strong anode is made with an embedded end of a multi-strand single sleeve insulated wire and is molded from a three part composition of polymer, carbon and silica gel. The anode is thin, about 3/32 of an inch thick, and about an inch and a half in diameter. The anode is made in circular or other configuration. The peripheral wall of the anode has dimples, which are engaged by snaps projected inward from walls of a low profile capsule. The conductor passes through an opening in the side wall of the capsule. Standoffs space the anode from the upper wall of the capsule. An outward extending flange of the capsule is coated with adhesive, which may cover a part or all of the base of the anode.

13 Claims, 1 Drawing Sheet

THIN ELECTRODES

This application is a continuation of Ser. No. 07/422,509, filed Oct. 7, 1989, now abandoned.

BACKGROUND OF THE INVENTION

Automotive cathodic protection systems are well known and have been in use for more than a decade. Important elements of the cathodic protection systems are electrodes or anodes, which are placed at strategic locations on an automobile body. While electrodes currently in use are highly satisfactory, a search goes on for better, stronger, less obtrusive electrodes and capsules in which they are held and for electrodes with improved operational and structural characteristics and with improved manufacturing and installation characteristics.

SUMMARY OF THE INVENTION

The present invention provides improved electrodes for automotive cathodic protection. Briefly, a thin strong anode is made with an embedded end of a multistrand single sleeve insulated wire and is molded from a three part composition of polymer, carbon and silica gel. One desired embodiment is less than ⅛ of an inch thick and preferably is about 3/32 of an inch thick. The anode is desired to have a cross-wise dimension between about one and two inches, and preferably about an inch and a half. The anode is preferably circular, but it may be made in a square or other configuration. The peripheral wall of the anode has dimples, which are engaged by snaps projected inward from walls of a low profile capsule. The conductor passes through an opening in the side wall of the capsule. Standoffs space the anode from the upper wall of the capsule. An outward extending flange of the capsule is coated with adhesive, which may cover a part or all of the base of the anode.

A preferred anode for automotive corrosion protection system comprises a thin, strong lightweight body formed from polymer, carbon and silica gel. The body has a generally flat upper surface and a generally flat lower surface joined by a side wall. An insulated wire has a first end which extends into the body. Conductors exposed from the insulated wire extend into the body in conductive contact with a dispersed conductive material in the body.

In a preferred embodiment the flat upper and lower walls of the anode have circular edges. The side wall is a cylindrical peripheral wall which joins edges of the upper and lower walls. Preferably the conductor extends into the body through the peripheral cylindrical wall. In a preferred embodiment the peripheral wall is provided with surface irregularities for joining to a cover. In one embodiment a cover shell has a generally flat upper wall having a circular edge. A generally cylindrical side wall extends downward from the circular edge, and a generally circular flange extends outward from a lower edge of the cylindrical wall. An opening in the cylindrical wall allows passage of the conductor. Complementary surface irregularities in an inner surface of the cylindrical wall opposite the flange interfit with the irregularities in the circular wall of the anode. Standoffs within the cover extend inward and downward from the flat wall toward the upper surface of the anode. Preferably adhesive adheres to a flat lower surface of the flange. In one embodiment adhesive is coated on the flat lower surface of the anode.

The preferred electrode is made out of a three part composition of a polymer resin, finely dispersed carbon or graphite and silica gel. Portions of the desired components may be varied. One desirable composition includes by weight about 60% to 70% or more polymer, about 20% to 40% or more carbon and less than 10% silica gel.

It is highly desirable to use about 5% or less silica gel, as much polymer as possible and as little carbon as possible in a stoichiometric relationship. As much polymer is used as is necessary to increase strength, without decreasing conductivity or as much carbon as possible is used to provide prerequisite conductivity and to add strength, when the dispersed carbon is in the form of fibers, particularly graphite fibers. As little silica gel as possible is used in keeping with the requirement of making the anode hydrophilic, to adsorb and absorb water and to increase conductivity within the anode and from the anode to the surrounding wetted automotive body surface.

The silica gel may be enriched in the surface areas of the anode and improvised in the center of the anode to provide increased wetability and surface conductivity characteristics without taking away from the desired toughness and strength characteristics. Preferably, the silica gel is a finely divided pulverized hydrolyzed silica colloidal form.

The carbon may be in any form suitable for providing conductivity of the electrode, which is the primary function of the carbon. Preferably, the carbon is also in fiber form, such as graphite fibers, which operate synergistically with the polymer to increase the strength of the anode while at the same time providing maximum conductivity. Preferably, the carbon is dispersed uniformly throughout the entire anode. Alternatively, the carbon may be dispersed in predetermined patterns within the anode and especially on surfaces of the anode to increase the surface electrical conductivity of the anode, and to increase internal electrical conductivity between the conductor wires and the outer conductive surface of the anode.

The polymer resin may be any suitable polymer which meets the test of providing strength and toughness, while preventing conductivity defeating self-skinning of the anode and maintaining a homogenous anode composition or a carbon and silica gel-rich condition on the surface.

Suitable extenders or fillers may be used, provided the fillers or extenders do not reduce the strength, conductivity or water adsorption of the surface. Provided the above tests are met, glass frit or glass flour in the form of microscopic glass balloons may be used as fillers or extenders. Preferably, the filler or extender performs the function of enhancing the conductivity and strength of the anode by uniformly distributing the conductive graphite fibers in the polymer.

The anode may be formed with a regular outer surface or with one or more irregular surfaces. The anode may be constructed with a hollow core, or the anode may be formed about a distinct solid core. Any suitable polymer may be used which provides the necessary requisites of strength, toughness and long wear, without reducing conductivity, surface conductivity and adsorption. The polymers may be, for example, polyethylene, oriented polyethylene, polyproylene, polyvinyl resin or any other suitable polymer or copolymer. Epoxy resins may be used. Any suitable molding technique may be used which preserves the desired distributional characteristics of the inclusions and the surface characteristics, and which is compatible with the wire lead which is connected to the anode as it is formed. Any multicavity molding techniques, including reaction injection molding techniques may be employed.

Preferably, an end of the sleeve is removed from the wire and the exposed ends of the multi-strand wires are spread, upset or crimped or otherwise deformed to anchor the wire in the anode as it is being formed.

Any suitable single or multi-strand wire may be used. A preferred wire has 18 strands with a single polymeric sleeve which is compatible with the polymer of the anode. The ends of the wires may be tinned or coated with highly conductive material or metal such as, for example, gold in a monomolecular layer.

The electrode may be used by itself and may be attached to a surface to be protected by an adhesive coating on the undersurface of the anode or on a portion of the undersurface of the anode, such as a peripheral portion or a uniformly patterned portion across the protected surface-anode interface.

In a preferred form of the invention, a peripheral surface of the anode is provided with surface variations which are used to connect the anode to a capsule or cover shell. In one form, the surface variations may be dimpled. There may be indentations or beads which fit together with complementary beads or indentations on an inner wall of a capsule.

A preferred shell is made with a shape similar to the anode, with a dimension only slightly larger than the anode. The capsule and anode snap together. The anode is displaced from the inner surface of the capsule cover by one or more standoffs. A preferred capsule has a peripheral base flange which extends outward and which has a lower surface substantially even with a lower surface of the anode. In a preferred form of the invention, the lower surface of the flange is coated with a permanent pressure sensitive adhesive. The adhesive coats the entire surface of the flange or coats the flange in patterns for connecting the flange and the shell to a surface to be protected and for holding the anode against the surface. The adhesive may be spread across the entire lower surface of the anode or in patterned areas on the lower surface. In a preferred embodiment, the adhesive is joined to the anode and the flanges at the same time.

Any suitable adhesive from a reputable manufacturer, for example 3M, may be used. The adhesive may be provided with a release shield which may be peeled from the fresh adhesive surface before adhering the shell and anode to a surface to be protected.

The standoffs assist in pressing the anode on the cleaned surface of the body to be protected.

A side wall of the cover is provided with an opening to permit passage of the conductor. The flange may have a slit connected to the opening so that the conductor may be inserted laterally through the slit into the shell. Preferably a free end of the wire is threaded through the shell after molding the anode on an end of the wire. When the shell is assembled on the wire before molding, the shell is slid a distance along the wire to prevent interference with the molding operations.

Further and other objects and features of the invention are apparent in the disclosure which includes the above and ongoing descriptive material including the claims and the drawings.

DETAILED DESCRIPTION OF THE DRAWINGS

Figure 1:
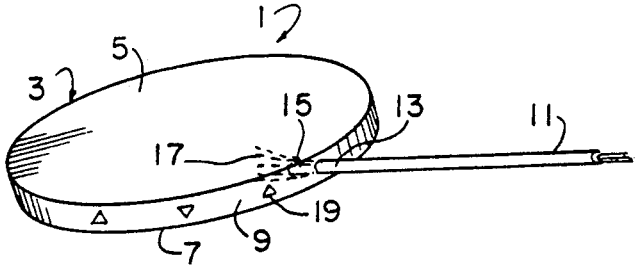
FIG. 1 shows an anode of the present invention with an attached wire.

Referring to the drawings, a preferred anode is generally referred to by the numeral 1. The anode has a molded body 3 with a flat upper surface 5 and a flat lower surface 7 joined by a peripheral surface 9. A lead 11 extends at 13 into the electrode body 3. An end 15 of the insulation on the lead 11 extends into the body, and individual strands 17 are spread or otherwise deformed to make good connection with the conductive material within the body 3.

Figure 2:
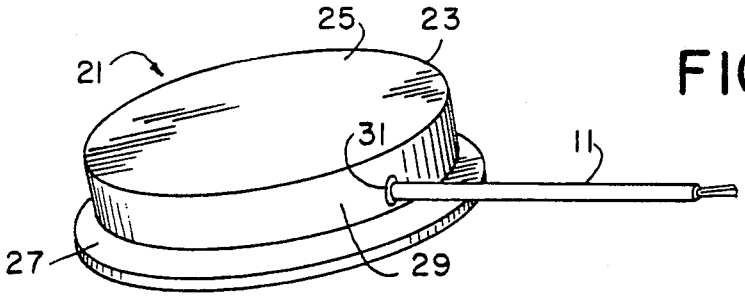
FIG. 2 shows an encapsulated anode of the present invention held within the cover shell.

The peripheral surface 9 is formed with surface irregularity mounting features such as dimples 19 which cooperate with complementary mounting features in the shell 21, shown in FIG. 2.

Shell 21 has a body 23 with a flat upper surface 25, in which indicia may be molded or on which labels may be attached. Body 23 has a flat circular peripheral base flange 27. A vertical cylindrical surface 29 joins an outer edge of the flat upper surface 25 and an inner edge of the flange 27. A hole 31 is formed in surface 39 to allow the passage of conductor 11. Other holes may be formed in the side surface to permit the free circulation of ambient air or moisture and to drain water.

Figure 3:
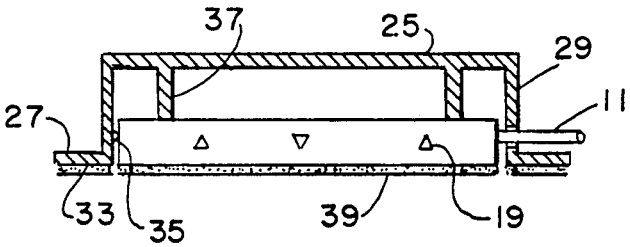
FIG. 3 is a side elevation of the capsule and anode showing the shell in cross section.

As shown in FIG. 3, the flange 27 has a flat underface 33. Snaps 35 are provided in the inner surfaces of the capsule to interfit with dimples 19 on the peripheral surface 9 of the anode. Standoffs 37 are provided between the top wall 25 of the shell 21 and the top surface 5 of the anode 1 to hold the anode downward within the shell and against the surface of the body. Adhesive 39 covers the entire under surface 33 of the flanges and surface 7 of the electrode. The adhesive may be replaced or augmented with another means for holding the anode and capsule against the body, for example, a magnet, a vacuum coupling, a mechanical coupling such as a snap or lock or bolt or any other equivalent permanent holding force producing means.

Figure 4:
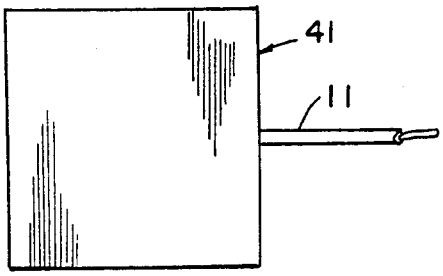
FIG. 4 is a plan view of an alternative form of the anode.

As shown in FIG. 4, the electrode may be made with a square body, in which case, the capsule cover will have a square shape and a cross section similar to that shown in FIG. 3.

While the invention has been described with reference to the specific embodiments, variations and modifications of the invention may be constructed without departing from the scope of the invention, which is set forth in the following claims.

I claim:

1. Apparatus comprising an anode for an automotive corrosion protection system comprising a thin, strong lightweight body made of a polymer material and a conductive material; said body having a generally flat upper surface and a generally flat lower surface with peripheral edges joined by a side surface, an insulated wire having a first end extending into the body, exposed conductors from the insulated wire extending into the body and being in conductive contact with the conductive material in the body, wherein the flat upper and lower surfaces have circular edges and wherein the side surface is a cylindrical peripheral surface which joins the circular edges of the upper and lower surfaces, wherein the insulated wire extends into the body through the peripheral cylindrical surface, wherein the peripheral surface is provided with plural surface irregularities for joining to a cover, said apparatus further comprising a cover shell having a generally flat upper wall having a circular edge, a generally cylindrical side wall extending downwardly from the circular edge of the upper wall, a generally circular flange extending outwardly from a lower edge of the cylindrical wall, an opening in the cylindrical wall for passage of the insulated wire and complementary plural surface detents in an inner surface of the cylindrical wall for interfitting with the plural irregularities in the peripheral surface of the anode.

2. The apparatus of claim 1 further comprising standoffs within the cover extending inwardly and downwardly from the flat wall toward the upper surface of the anode.

3. The apparatus of claim 2 further comprising an adhesive adhered to a flat lower surface of the flange.

4. The apparatus of claim 3 further comprising adhesive adhered to the flat lower surface of the anode.

5. The apparatus of claim 1 wherein the conductive material is carbon.

6. The apparatus of claim 5 wherein the carbon is in the form of carbon fibers.

7. The apparatus of claim 6 wherein the carbon fibers are graphite fibers.

8. The apparatus of claim 5 wherein the polymer material and carbon are in a ratio of at least about 70% polymer and up to about 30% carbon.

9. The apparatus of claim 5 wherein the polymer and carbon are in a ratio by weight of about 70% polymer, and about 30% of carbon.

10. An automotive corrosion protection apparatus comprising an anode having a flat, thin, strong body made of a polymer and a conductive material dispersed in the polymer, the body having a generally flat upper surface and a generally flat lower surface and a side surface joining outer edges of the upper and lower surfaces, a conductor extending through the side surface from the body, the conductor having conductive elements in contact with conductive material in the body, and an insulation surrounding the conductor as it extends from the body, and a means for holding the anode against an automobile body surface to be protected, wherein the conductive material is carbon, wherein the body has a thickness of less than ⅛th of an inch thick, and wherein the surfaces have a cross-wise dimension of between about 1 and 2 inches, said apparatus further comprising a capsule cover having an upper wall with a shape similar to the upper surface of the anode body and having a peripheral wall joined to an outside edge of the upper wall and extending therefrom. Said peripheral wall having a peripheral flange extending outwardly from an end thereof opposite the upper wall, detents on an inner surface of the peripheral wall of the capsule cover, and complementary detents in the side surface of the anode which engage the detents in the inner surface of the peripheral wall of the cover for holding the anode aligned in the capsule cover with a lower surface of the anode generally in a planar relationship with a lower surface of the flange of the capsule cover.

11. The apparatus of claim 10 further comprising plural standoffs extending from an inner surface of the upper wall of the cover to the upper surface of the anode for holding the upper surface of the anode spaced from the cover.

12. The apparatus of claim 11 further comprising an adhesive connected to the lower surface of the flange and the lower surface of the anode for mounting the anode and the capsule cover on a surface of an automobile body to be protected.

13. The apparatus of claim 11 further comprising an adhesive coating on the lower surface of the peripheral flange for holding the peripheral flange and the anode on a surface of an automotive body to be protected.

* * * * *